US007334557B2

(12) United States Patent
Callan

(10) Patent No.: US 7,334,557 B2
(45) Date of Patent: Feb. 26, 2008

(54) ENGINE LUBRICATION SYSTEM FOR SUPPLEMENTAL OIL FILTERING AND CONTROLLER BASED ACTIVATION OF A PRELUBRICATION PUMP

(76) Inventor: Thomas Callan, 11 Half Penny La., Old Saybrook, CT (US) 06475

( * ) Notice: Subject to any disclaimer, the term of this patent is extended or adjusted under 35 U.S.C. 154(b) by 159 days.

(21) Appl. No.: 11/282,543

(22) Filed: Nov. 17, 2005

(65) Prior Publication Data

US 2006/0102133 A1 May 18, 2006

Related U.S. Application Data

(60) Provisional application No. 60/629,369, filed on Nov. 18, 2004.

(51) Int. Cl.
*F01M 11/03* (2006.01)
*F01M 11/10* (2006.01)

(52) U.S. Cl. ..... 123/196 A; 123/196 S

(58) Field of Classification Search ..... 123/196 R, 123/196 S, 196 A

See application file for complete search history.

(56) References Cited

U.S. PATENT DOCUMENTS 4,388,185 A * 6/1983 Ott et al. ..... 210/136
4,825,826 A * 5/1989 Andres ..... 123/196 S
4,834,039 A * 5/1989 Apostolides ..... 123/196 S
4,890,695 A * 1/1990 Morris et al. ..... 184/6.3
4,940,114 A * 7/1990 Albrecht ..... 184/6.3
4,971,704 A * 11/1990 Johnson, Sr. ..... 210/741
5,089,129 A * 2/1992 Brigman ..... 210/223
5,121,720 A * 6/1992 Roberts ..... 123/196 S
5,195,476 A * 3/1993 Schwarz ..... 123/179.5
5,488,935 A * 2/1996 Berry, Jr. ..... 123/196 S
5,511,522 A * 4/1996 Tran ..... 123/196 S
5,782,315 A * 7/1998 Reinosa ..... 184/6.3
5,894,825 A * 4/1999 Duerr ..... 123/196 S
6,029,621 A * 2/2000 Berels ..... 123/196 S
6,368,497 B1 * 4/2002 de Sylva ..... 210/120
6,523,519 B2 * 2/2003 Iwano et al. ..... 123/196 R
6,655,342 B1 * 12/2003 Wendels et al. ..... 123/196 R

* cited by examiner

*Primary Examiner*—Stephen K. Cronin
(74) *Attorney, Agent, or Firm*—Michaud-Duffy Group LLP

(57) ABSTRACT

An engine lubrication system comprising a pump for supplying oil to an engine, a filter for purifying the oil and at least one sensor for discerning parameters of the engine lubrication system and generating signals indicative thereof. The engine lubrication system includes a controller operable to receive the signals generated by the sensors and to issue commands responsive thereto.

22 Claims, 3 Drawing Sheets

ENGINE LUBRICATION SYSTEM FOR SUPPLEMENTAL OIL FILTERING AND CONTROLLER BASED ACTIVATION OF A PRELUBRICATION PUMP

CROSS-REFERENCE TO RELATED APPLICATION

This application claims priority from provisional application Ser. No. 60/629,369, filed Nov. 18, 2004, the disclosure of which is incorporated herein by reference in its entirety.

FIELD OF THE INVENTION

The present invention is generally directed to an engine lubrication system and is more specifically directed to a supplemental oil filter assembly and prelubrication pump operable prior to or immediately upon engine ignition.

BACKGROUND OF THE INVENTION

Lubrication is critical for the operation and life expectancy of an engine. Those skilled in the art of engine lubrication have long understood that maintaining the purity of oil used for lubrication is an important factor relative to operating and extending the life of the engine. During engine operation, normal wear causes particles as small as one micron to be dislodged into lubricating oil being circulated through the engine. These particles detrimentally affect the lubricating characteristics of the oil. Conventional oil filters typically remove particles as small as 20 to 40 microns. Byproducts of combustion associated with operation of the engine also mix with the oil and increase the acidity thereof. Such an increase in acidity can accelerate corrosion of engine components exposed to the oil, resulting in deterioration of engine performance and decreased engine life. Oil contamination can also be caused by condensation, fuel, and anti-freeze mixing with the oil. Periodic oil changes are usually required to remove contaminated oil and replenish the engine with clean oil. Disposal of the contaminated oil can involve significant environmental considerations. However, operating an engine wherein the lubrication properties of the lubricating oil circulating therethrough have been compromised can rapidly cause poor engine operation.

In addition to the problems associated with operating and engine with contaminated oil, it is well known to those in the field of engine design that a significant amount of engine wear is associated with starting the engine. This is due to the fact that, over time, oil drains off the previously lubricated engine components. Some of these components contact one another during operation with the potential of generating high friction. These engine components are not lubricated until the engine has been operating for a period of time sufficient to reestablish oil circulation. In addition, after an engine is shut down, certain engine components such as turbochargers remain hot absent continuing flow of oil, thus creating a potential for accelerated wear or fouling.

The prior art has established that providing an engine with an oil reservoir, a filter and a pump for supplying oil to components which require lubrication can help maintain engine performance and extend operating life. However, there is a need to provide an improved engine lubrication system capable of removing smaller particles from the oil and for providing oil to the engine in advance of conventional oil pumps forming part of the engine. Prior art methods and systems attempting to address these needs have failed to provide a solution which provides these capabilities. Based on the foregoing, it is the general object of the present invention to improve upon or overcome the problems and drawbacks of the prior art.

SUMMARY OF THE INVENTION

According to one aspect of the present invention, an engine lubrication system is provided which includes a prelubrication pump for supplying oil to an engine for a predetermined period of time, ahead of that supplied by a conventional oil pump forming part of the engine. There is a sensor for monitoring operation of said engine lubrication system and generating signals indicative thereof. There is a controller in communication with the prelubrication pump and the sensor for receiving the signals therefrom and issuing commands in response thereto. A controller is in communication with an ignition switch operable to initiate ignition of said engine and is operable to receive an engine ignition signal and to generate pump-start commands to operate the prelubrication pump for the predetermined period of time. The controller may also activate the prelubrication pump for another predetermined period of time, upon termination of engine operation. In the preferred embodiment of the present invention, the engine lubrication system includes a supplemental oil filter assembly so that during operation of the engine, a portion of the oil flowing therethrough is diverted to the supplemental oil filter assembly, thereby providing enhanced purification of the oil, thus further purifying a portion of the oil supplied by the conventional oil pump. The prelubrication pump also forces oil through the supplemental oil filter assembly during the predetermined period of time. The magnitude of the flow rate of oil through the supplemental oil filter assembly is established by a flow control device in fluid communication with the supplemental oil filter assembly. In addition, the supplemental oil filter assembly includes a replaceable filter, preferably a cotton-fiber material, capable of removing particles as small as one micron, from the oil. The filter contains an acid neutralizing agent for neutralizing the acidity of the oil.

In accordance with another aspect of the present invention, the supplemental oil filter assembly includes a filter housing having an evaporation chamber contained therein. A heater projects into the evaporation chamber and is contained within the filter housing. The heater causes a rise in temperature of the oil and evaporates liquid contaminants contained in the oil, thereby producing evaporated contaminants. A bleed hole penetrating through the filter housing provides a path for removal of the evaporated contaminants. A flow limiting device in fluid communication with the bleed hole is provided for controlling removal of evaporated contaminants while preventing flow of oil therethrough. A pressure sensor is provided to detect engine oil pressure and generate a heater-start signal for transmission to the controller. When engine oil pressure has reached a predetermined value the controller issues commands for providing power to the heater.

A further aspect of the present invention reveals a current sensor for detecting current flow through the heater. In addition, a flow sensor, preferably an infrared flow sensor is disposed in an outlet flow path of the supplemental oil filter assembly to detect oil flow exiting therefrom. Heater current and oil flow signals are transmitted to the controller for indication of heater current and oil flow on a display.

DETAILED DESCRIPTION OF THE PREFERRED EMBODIMENT

Figure 1:
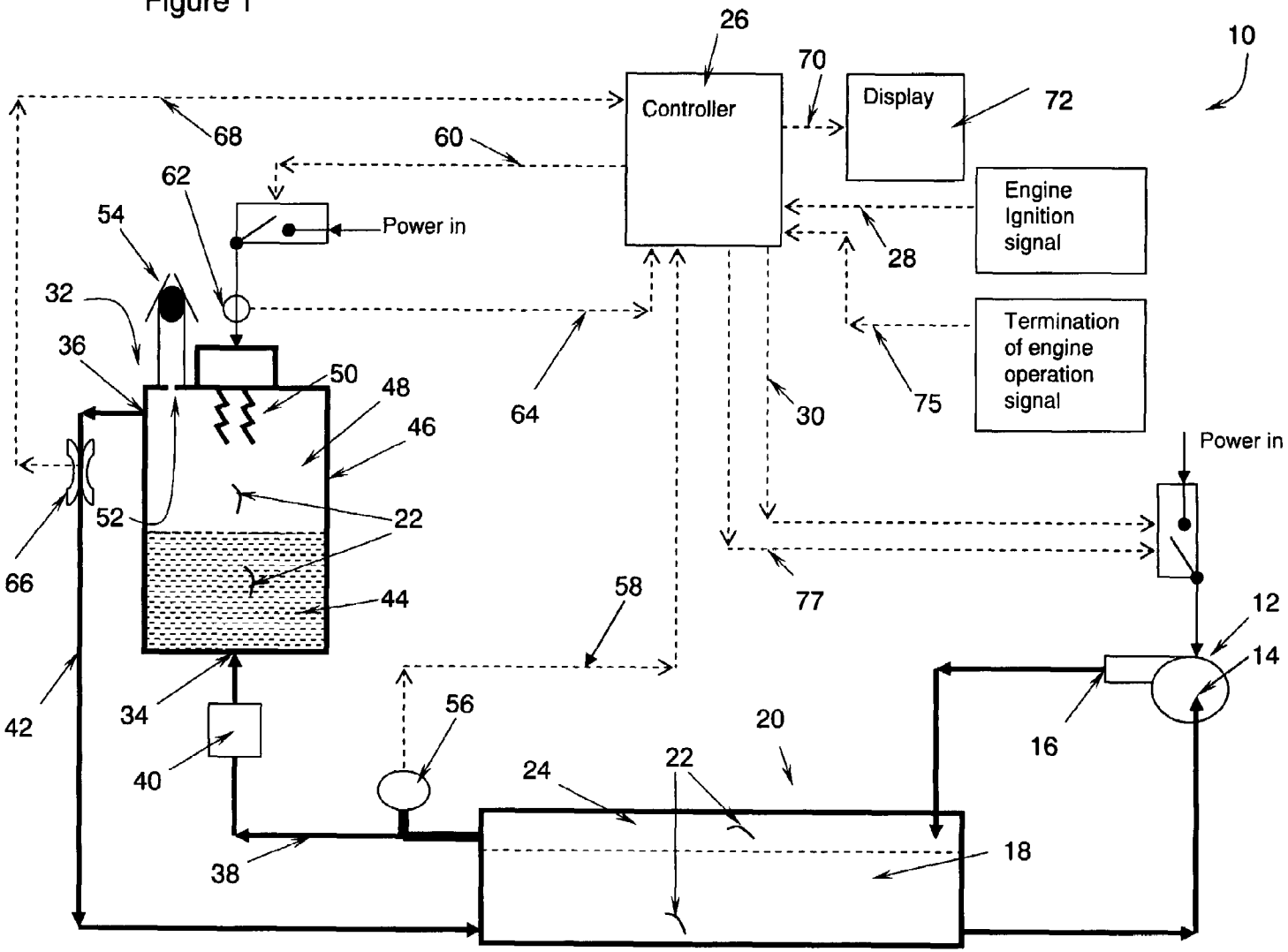
FIG. 1 is a schematic illustration of an engine lubrication system in accordance with the present invention including a prelubrication pump, a supplemental oil filter assembly, a controller and a display.

As shown in FIG. 1 an engine lubrication system 10 includes a prelubrication pump 12, having a suction port 14 and a discharge port 16. The suction port 14 is in fluid communication with a low pressure cavity 18 of an engine 20 and supplies oil 22 via the suction port to the prelubrication pump 12. The discharge port 16 is shown in fluid communication with a high pressure cavity 24 of the engine 20 and supplies oil 22 thereto. A controller 26 is included and is in communication with an ignition system of the engine. The controller 26 receives signals indicative of engine ignition 28 and generates and transmits pump-start commands 30 for operating the prelubrication pump 12, responsive to the signals indicative of engine ignition. The oil 22 is supplied to the engine 20 by the prelubrication pump 12, for a predetermined time, ahead of that supplied by a conventional oil pump (not shown) forming part of the engine 20. Although the prelubrication pump 12 is shown supplying the oil 22 from the low pressure cavity 18, to the high pressure cavity 24, oil can be supplied to other components of the engine such as, but not limited to, a turbocharger.

As illustrated in FIG. 1 the engine lubrication system 10 includes a supplemental oil filter assembly 32 having an inlet connection 34 and an outlet connection 36. An inlet flow path 38 provides fluid communication between the high pressure cavity 24 of the engine 20 and the inlet connection 34 of the supplemental oil filter assembly 32. In addition, a flow control device 40 such as but not limited to a metering jet, a control valve or an orifice for controlling flow of oil 22 into the supplemental oil filter assembly 32 is disposed in the inlet flow path 38. The outlet connection 36 of the supplemental oil filter assembly 32 is in fluid communication with the low pressure cavity 18 of the engine 20, coupled thereto by an outlet flow path 42. The prelubrication pump 12 also forces the oil 22 through the high pressure cavity 24 of the engine 20, into the inlet flow path 38, through the flow control device 40, into the supplemental oil filter assembly 32, and through the outlet path 42 returning purified oil to the low pressure cavity 18 of the engine 20.

The supplemental oil filter assembly 32 contains a filter 44 made from a suitable material such as but not limited to cotton-fiber. The filter 44 is capable of removing particles as small as one micron, from the oil 22. An acid neutralizing agent (not shown) for neutralizing the acidity of the oil 22 is contained within the filter 44. While a filter 44 capable of removing particles as small as one micron from the oil 22 has been described, the present invention is not limited in this regard as other filters capable of removing even smaller particle sizes from the oil may also be used. Although an acid neutralizing agent is shown contained within the filter 44, other arrangements may also be used, such as but not limited to, an acid neutralizing agent separate from the filter and loose beads containing the acid neutralizing agent.

In addition, the supplemental oil filter assembly 32 includes a filter housing 46 containing an evaporation chamber 48 for purifying the oil 22. A heater 50 projects into the evaporation chamber 48 and is contained within the filter housing 46. The heater 50, in response to commands issued from the controller 26, causes a rise in temperature of the oil 22 and thereby the liquid contaminants contained therein, generating evaporated contaminants therefrom. A bleed hole 52 penetrating through the filter housing 46 and in fluid communication with the evaporation chamber 48 provides a path for removal of the evaporated contaminants from the filter housing. In addition, a flow limiting device 54 in fluid communication with the bleed hole 52 regulates removal of the evaporated contaminants and prevents flow of the oil 22 therethrough. A pressure sensor 56 is in fluid communication with the high pressure cavity 24 for sensing pressure therein. The pressure sensor 56 generates and transmits a pressure signal 58 indicative of pressure in the high pressure cavity 24, to the controller 26 which issues heater start commands 60 in response to the pressure signal 58 being indicative of a predetermined value, for activating power to the heater 50. Although the pressure sensor 56 shown generates and transmits a pressure signal 58 to the controller 26, which issues heater start commands 60 in response to the pressure signal 58 for activating power to the heater 50, the present invention is not limited in this regard as other devices can be used including but not limited to a pressure switch activating power to the heater 50.

Still referring to FIG. 1, the engine lubrication system 10 includes a current sensor 62 in electrical communication with the heater 50 for detecting current flow through the heater 50 and generating a current signal indicative thereof. An infrared flow sensor 66 is shown on the outlet flow path 42 for generating a flow signal 68, indicative of oil flow exiting the supplemental oil filter assembly 32. The current signal 64 and the flow signal 68 are transmitted to the controller 26. In addition, the controller 26 issues display commands 70 to a display 72 for indicating oil flow, heater current, pump operating status, and engine operating status. While an infra red flow sensor is described, the present invention is not limited in this regard as other flow sensors may also be used, including but not limited to ultra-sonic flow sensors, fiber-optic flow sensors and differential pressure flow sensors.

The controller 26 is also operable to receive signals indicative of termination of engine operation 75 and to generate second pump start commands 77 in response thereto. Operation of the prelubrication pump 12, for another predetermined period of time, is thereby initiated by the controller 26 as a result of the second pump start commands 77. The prelubrication pump 12 provides the oil 22 to the engine beyond that supplied by a conventional oil pump forming part of the engine.

Figure 2:
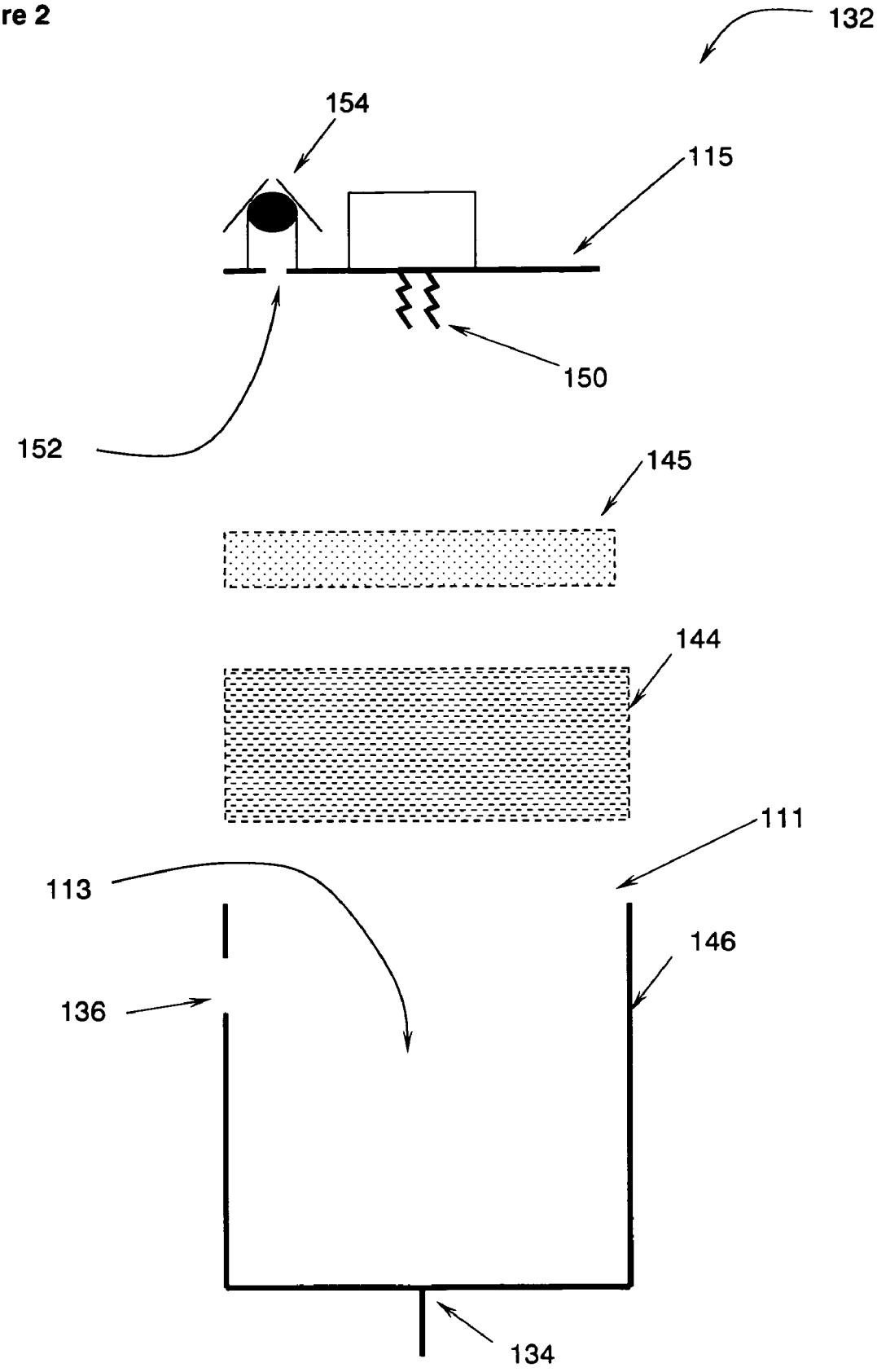
FIG. 2 is an exploded front view of the supplemental oil filter assembly forming part of the engine lubrication system of FIG. 1.

The embodiment shown in FIG. 2 is similar to that of FIG. 1, therefore like elements will be given like numbers preceded by the numeral 1. The supplemental oil filter assembly 132 includes an open end 111 exposing an interior area 113 of the filter housing 146. The open end 111 allows containment of the filter 144 and an acid neutralizing device 145 within the interior area 113 of the filter housing 146. The acid neutralizing device 145 and the filter 144 are shown separate from one another in the illustrated embodiment. A cover 115 removably coupled to the open end 111 of the filter housing 146 is provided for access to the interior area 113 and for sealing the open end of the filter housing. The cover 115 includes the heater 150 removably attached thereto. The bleed hole 152 is shown penetrating through the cover 115 in fluid communication with the flow limiting device 154. In addition, the flow limiting device 154 is also removably attached to the cover 115. Although the supplemental oil filter assembly 132 described includes the filter housing 146, the open end 111 and the cover 115, the present invention is not limited in this regard as other filter assemblies may be used including but not limited to screw-on canisters. While one acid neutralizing agent is shown in the current embodiment, the present invention is not limited in this regard as multiple acid neutralizing agents may be used such as but not limited to multiple loose beads containing the acid neutralizing agent.

Figure 3:
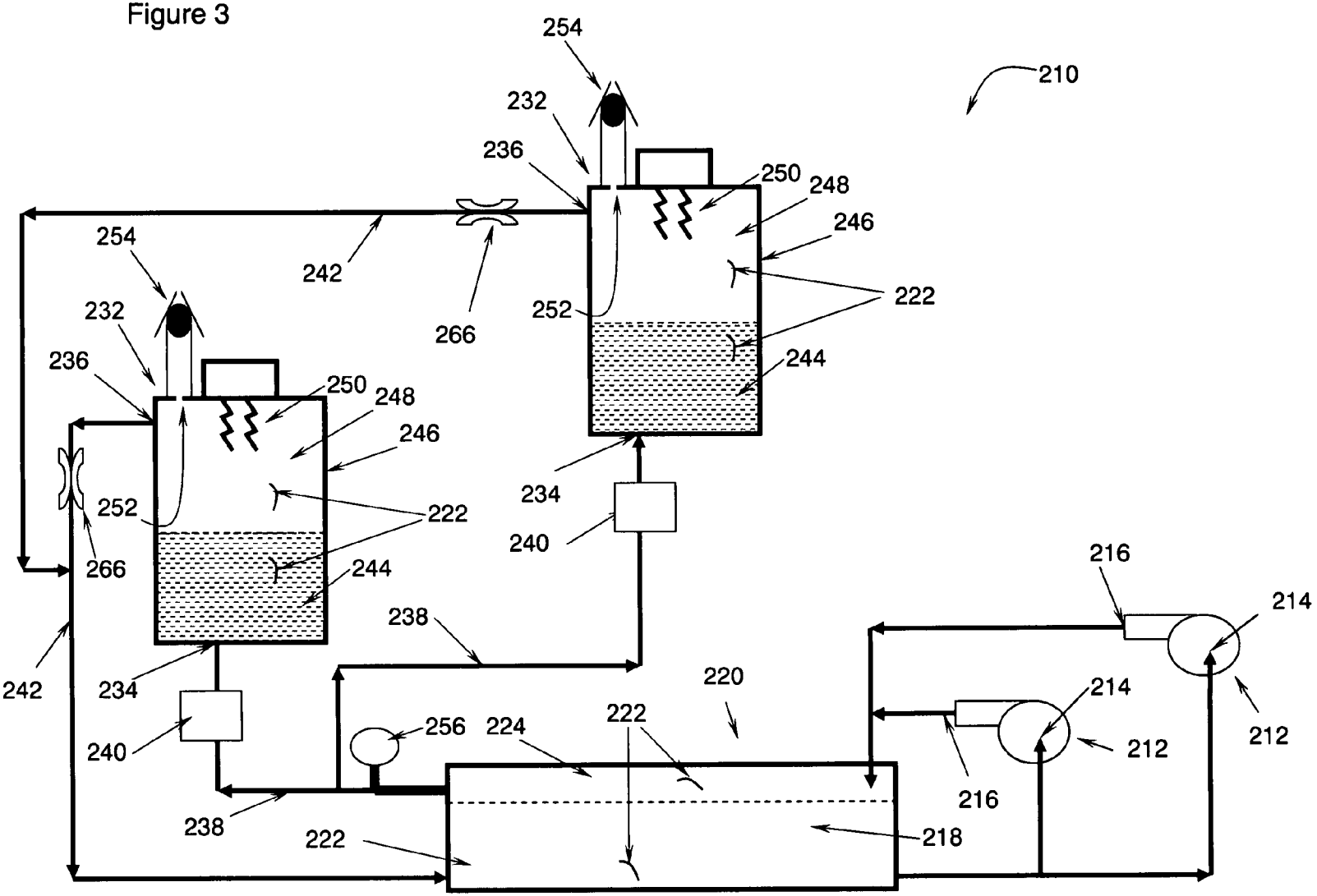
FIG. 3 is a schematic illustration of a portion of the engine lubrication system depicting two prelubrication pumps, two supplemental oil filter assemblies and the fluid connections thereof.

The embodiment shown in FIG. 3 is similar to that of FIG. 1, therefore like elements will be given like numbers preceded by the numeral 2. As shown in FIG. 3, the engine lubrication system 210 includes two prelubrication pumps 212 wherein the suction ports 214 are in fluid communication with the low pressure cavity 218 of the engine 220 and the discharge ports 216 are in fluid communication with the high pressure cavity 224. The engine lubrication system 210, shown in FIG. 3, also includes two supplemental oil filter assemblies 232 having inlet connections 234 and outlet connections 236. Inlet flow paths 238 provide fluid communication between the high pressure cavity 224 of the engine 220 and the inlet connections 234 of the supplemental oil filter assemblies 232. In addition, flow control devices 240 for restricting oil flow to the supplemental oil filter assemblies 232 are disposed in the inlet flow paths 238. The outlet connections 236 of the supplemental oil filter assemblies 232 are in fluid communication with the low pressure cavity 218 of the engine 220, coupled thereto by outlet flow paths 242. Although two prelubrication pumps 212 and two supplemental oil filter assemblies 232 are shown in FIG. 3, the present invention is not limited in this regard as additional prelubrication pumps and supplemental oil filter assemblies can also be used. While FIG. 3 illustrates two prelubrication pumps 212 in parallel fluid connection, the present invention is not limited in this regard as at least two prelubrication pumps may also be fluidly connected in series or at least three prelubrication pumps can be fluidly connected in a combination of series and parallel. Although two supplemental oil filter assemblies are shown in parallel fluid connection, the present invention is not limited in this regard as at least two supplemental oil filter assemblies can also be fluidly connected in series or at least three supplemental oil filter assemblies can be fluidly connected in a combination of series and parallel.

Although the present invention has been disclosed and described with reference to certain embodiments thereof, it should be noted that other variations and modifications may be made, and it is intended that the following claims cover the variations and modifications within the true spirit of the invention.

What is claimed is:

1. An engine lubrication system for an engine comprising a conventional first oil pump and a first oil filter, the system comprising:

at least a second pump comprising a prelubrication pump in fluid communication with an engine so that upon initiation of engine ignition, said prelubrication pump supplies oil, for a predetermined time, to said engine ahead of that supplied by a conventional oil pump forming part of said engine;

at least one supplemental oil filter assembly comprising a second oil filter in fluid communication with said engine and said prelubrication pump so that during operation of said engine a portion of said oil flowing therethrough is diverted to said supplemental oil filter assembly thereby providing enhanced purification of said oil;

sensing means for monitoring operation of said engine lubrication system and generating signals indicative thereof; and a controller in communication with said prelubrication pump and said sensor for receiving said signals therefrom and issuing commands in response thereto, said controller further being in communication with an ignition switch operable to initiate ignition of said engine, and wherein upon said initiation of engine ignition said controller causes said prelubrication pump to operate.

2. The engine lubrication system of claim 1, wherein said supplemental oil filter assembly includes:

a filter housing containing an evaporation chamber therein, wherein said oil flows through said evaporation chamber for purification of said oil.

3. The engine lubrication system of claim 1, wherein said engine lubrication system includes:

said prelubrication pump in fluid communication with said supplemental oil filter assembly so that upon initiation of engine ignition, said prelubrication pump supplies said oil, for a predetermined time, through said supplemental oil filter assembly ahead of that supplied by said conventional oil pump forming part of said engine.

4. The engine lubrication system of claim 1, wherein said supplemental oil filter assembly includes:

a flow control device in fluid communication with said supplemental oil filter assembly and said engine, said flow control device positioned therebetween, for controlling flow of said oil into said supplemental oil filter assembly.

5. The engine lubrication system of claim 1, wherein said supplemental oil filter assembly includes:

a filter housing containing a heater projecting therein, wherein said heater causes a rise in temperature of said oil and liquid contaminants contained therein and generates evaporated contaminants therefrom.

6. The engine lubrication system of claim 5, wherein said engine lubrication system includes:

a current sensor in electrical communication with said heater for sensing current flowing through said heater and generating a current signal indicative thereof, said current signal being transmitted to said controller, wherein said controller issues said commands responsive to said current signal.

7. The engine lubrication system of claim 5, wherein said supplemental oil filter assembly further includes:

a bleed hole penetrating through said filter housing for removal of said evaporated contaminants contained therein.

8. The engine lubrication system of claim 7, wherein said supplemental oil filter assembly further includes:

a flow limiting device in fluid communication with said bleed hole, wherein said flow limiting device regulates removal of said evaporated contaminants from said filter housing and prevents flow of said oil from said filter housing.

9. The engine lubrication system of claim 1, wherein said supplemental oil filter assembly includes:

a filter housing for containing said oil flowing therethrough and enclosing a filter capable of removing particles as small as about one micron from said oil.

10. The engine lubrication system of claim 9, wherein said filter includes:

an acid neutralizing agent for neutralizing acidity of said oil flowing therethrough, wherein said acid neutralizing agent is contained within said filter.

11. The engine lubrication system of claim 9, wherein said filter housing includes:

an acid neutralizing agent separate from said filter for neutralizing acidity of said oil flowing therethrough, wherein said acid neutralizing agent is enclosed within said filter housing.

12. The engine lubrication system of claim 9, wherein said filter is of a cotton-fiber material.

13. The engine lubrication system of claim 9, wherein said filter housing includes:

an open end exposing an interior area of said filter housing, wherein said open end allows containment of said filter and an acid neutralizing device within said interior area of said filter housing, and a cover removably coupled to said open end for access to said interior area of said filter housing and for sealing said open end.

14. An engine lubrication system for an engine that comprises a conventional first oil pump and first filter, the system comprising:

at least one second, prelubrication pump in fluid communication with an engine so that upon initiation of engine ignition, said prelubrication pump supplies oil, for a predetermined time, to said engine ahead of that supplied by the conventional oil pump;

at least one supplemental oil filter assembly comprising a second, supplemental oil filter in fluid communication with said engine and said prelubrication pump so that during operation of said engine a portion of said oil flowing therethrough is diverted to said supplemental oil filter assembly thereby providing enhanced purification of said oil;

sensing means for monitoring operation of said engine lubrication system and generating signals indicative thereof; and a controller in communication with said prelubrication pump and said sensor for receiving said signals therefrom and issuing commands in response thereto, said controller further being in communication with an ignition switch operable to initiate ignition of said engine, and wherein upon said initiation of engine ignition said controller causes said prelubrication pump to operate, wherein said engine sensing means includes;

a pressure sensor in fluid communication with said engine for sensing oil pressure of said engine and generating a pressure signal indicative thereof, wherein said pressure signal is transmitted to said controller, and wherein said controller issues commands responsive to said pressure signal.

15. The engine lubrication system of claim 14, wherein said engine lubrication system includes:

a filter housing containing a heater projecting therein, wherein said heater causes a rise in temperature of said oil and liquid contaminants contained therein and generates evaporated contaminants therefrom, and wherein said commands responsive to said pressure signal are heater start commands for activating power to said heater.

16. An engine lubrication system for an engine that comprises a conventional first oil pump and first filter, the system comprising:

at least one second, prelubrication pump in fluid communication with an engine so that upon initiation of engine ignition, said prelubrication pump supplies oil, for a predetermined time, to said engine ahead of that supplied by the conventional oil pump;

at least one supplemental oil filter assembly comprising a second, supplemental oil filter in fluid communication with said engine and said prelubrication pump so that during operation of said engine a portion of said oil flowing therethrough is diverted to said supplemental oil filter assembly thereby providing enhanced purification of said oil;

sensing means for monitoring operation of said engine lubrication system and generating signals indicative thereof; and a controller in communication with said prelubrication pump and said sensor for receiving said signals therefrom and issuing commands in response thereto, said controller further being in communication with an ignition switch operable to initiate ignition of said engine, and wherein upon said initiation of engine ignition said controller causes said prelubrication pump to operate;

wherein said engine lubrication system includes:

a filter housing containing a heater projecting therein, wherein said heater causes a rise in temperature of said oil and liquid contaminants contained therein and generates evaporated contaminants therefrom; and a pressure switch in fluid communication with said engine for sensing oil pressure of said engine and generating a pressure signal indicative thereof, wherein said pressure signal activates power to said heater.

17. An engine lubrication system for an engine that comprises a conventional first oil pump and first filter, the system comprising:

at one second, prelubrication pump in fluid communication with an engine so that upon initiation of engine ignition, said prelubrication pump supplies oil, for a predetermined time, to said engine ahead of that supplied by the conventional oil pump;

at least one supplemental oil filter assembly comprising a second, supplemental oil filter in fluid communication with said engine and said prelubrication pump so that during operation of said engine a portion of said oil flowing therethrough is diverted to said supplemental oil filter assembly thereby providing enhanced purification of said oil;

sensing means for monitoring operation of said engine lubrication system and generating signals indicative thereof; and a controller in communication with said prelubrication pump and said sensor for receiving said signals therefrom and issuing commands in response thereto, said controller further being in communication with an ignition switch operable to initiate ignition of said engine, and wherein upon said initiation of engine ignition said controller causes said prelubrication pump to operate;

wherein said engine lubrication system includes:

a filter housing containing a heater projecting therein, wherein said heater causes a rise in temperature of said oil and liquid contaminants contained therein and generates evaporated contaminants therefrom;

at least one of a current sensor and a flow sensor, the current sensor being in electrical communication with said heater for sensing current flowing through said heater and generating a current signal indicative thereof, said current signal being transmitted to said controller, wherein said controller issues said commands responsive to said current signal, and the flow sensor detecting flow of said oil exiting said supplemental oil filter assembly, wherein said flow sensor generates a flow signal indicative of flow of said oil exiting said supplemental oil filter assembly for transmission to said controller, and wherein said controller generates commands responsive to said flow signal; and a display operable to receive said commands from said controller, wherein said commands are display commands for generating at least one of a heater current indication and an indication of flow of said oil exiting said supplemental oil filter assembly on said display.

18. The engine lubrication system of claim 17, comprising an infrared flow sensor, a differential pressure flow sensor, a fiber-optic flow sensor or an ultra-sonic flow sensor.

19. An engine lubrication system comprising:

a prelubrication pump in fluid communication with an engine so that upon termination of operation of said engine, said prelubrication pump supplies oil, for a predetermined time, to said engine beyond that supplied by a conventional oil pump forming part of said engine, a sensing means for monitoring operation of said engine lubrication system and generating signals indicative thereof; and a controller in communication with said prelubrication pump and said sensor for receiving said signals therefrom and issuing commands in response thereto, said controller further being in communication with an ignition switch operable for termination of operation of said engine;

a pressure sensor in fluid communication with said engine for sensing oil pressure of said engine and generating a pressure signal indicative thereof, wherein said pressure signal is transmitted to said controller, and wherein said controller issues commands responsive to said pressure signal; and a filter housing containing a heater projecting therein, wherein said heater causes a rise in temperature of said oil and liquid contaminants contained therein and generates evaporated contaminants therefrom, and wherein said commands responsive to said pressure signal are heater start commands for activating power to said heater; and wherein upon said termination of operation of said engine, said controller causes said prelubrication pump to operate.

20. A method for lubrication of an engine that comprises an oil reservoir, a conventional first oil pump and a first oil filter, the system comprising:

providing an engine lubrication system including at least one prelubrication pump comprising a second oil pump in fluid communication with an engine so that upon initiation of engine ignition, said prelubrication pump supplies oil, for a predetermined time, to said engine ahead of that supplied by a conventional oil pump forming part of said engine; at least one supplemental oil filter assembly comprising a second oil filter in fluid communication with said engine and said prelubrication pump so that during operation of said engine a portion of said oil flowing therethrough is diverted to said supplemental oil filter assembly thereby providing enhanced purification of said oil; sensing means for monitoring operation of said engine lubrication system and generating signals indicative thereof; and a controller in communication with said prelubrication pump and said sensor for receiving said signals therefrom and issuing commands in response thereto, said controller further being in communication with an ignition switch operable to initiate ignition of said engine, and wherein upon said initiation of engine ignition said controller causes said prelubrication pump to operate;

initiating engine ignition;

generating a signal indicative of initiating engine ignition for transmission to said controller;

issuing commands to start said prelubrication pump for a predetermined period of time;

supplying said oil to said engine and through said supplemental oil filter assembly via said prelubrication pump;

supplying oil to said engine by a conventional oil pump forming part of said engine;

terminating operation of prelubrication pump;

flowing said oil through said supplemental oil filter assembly for enhanced purification of said oil.

21. The method of claim 20, further comprising terminating operation of said engine;

generating a signal indicative of termination of operation of said engine for transmission to said controller;

issuing commands to start said prelubrication pump for a predetermined period of time;

supplying said oil to said engine and through said supplemental oil filter assembly via said prelubrication pump; and terminating operation of said prelubrication pump.

22. The method of claim 20, further comprising heating the oil in response to sensing oil pressure in the engine.

* * * * *